US012247804B2

(12) United States Patent
Keller

(10) Patent No.: US 12,247,804 B2
(45) Date of Patent: Mar. 11, 2025

(54) ADJUSTABLE CHEEK RISER WITH AN ADJUSTABLE CHEEK PLATE

(71) Applicant: B5 Systems, Inc., Xenia, OH (US)

(72) Inventor: Mark J. Keller, Dayton, OH (US)

(73) Assignee: B5 SYSTEMS, INC., Xenia, OH (US)

( * ) Notice: Subject to any disclaimer, the term of this patent is extended or adjusted under 35 U.S.C. 154(b) by 110 days.

(21) Appl. No.: 17/967,677

(22) Filed: Oct. 17, 2022

(65) Prior Publication Data

US 2023/0122203 A1 Apr. 20, 2023

Related U.S. Application Data

(60) Provisional application No. 63/256,994, filed on Oct. 18, 2021.

(51) Int. Cl.
*F41C 23/14* (2006.01)

(52) U.S. Cl.
CPC ..... *F41C 23/14* (2013.01)

(58) Field of Classification Search
CPC ..... F41C 23/14
See application file for complete search history.

(56) References Cited

U.S. PATENT DOCUMENTS

| | | | | |
|---|---|---|---|---|
| 2008/0028662 | A1* | 2/2008 | Abraham | F41C 23/14 42/74 |
| 2018/0202756 | A1* | 7/2018 | Shinkle | F41C 23/14 |
| 2019/0056192 | A1* | 2/2019 | Frazier | F41C 23/14 |
| 2022/0057167 | A1* | 2/2022 | Lehr | F41C 23/20 |

* cited by examiner

*Primary Examiner* — J. Woodrow Eldred
(74) *Attorney, Agent, or Firm* — Eversheds Sutherland (US) LLP

(57) ABSTRACT

An adjustable cheek riser is described. The cheek riser may include a cheek plate and a mounting plate. The cheek plate may removably couple to the mounting plate and configured to slide laterally along a mounting plate length. The cheek riser may further include a horizontal adjustment mechanism, which may include a first fastening member and a second fastening member. The first fastening member may be disposed on the cheek plate and may include a male boss. The second fastening member may be disposed on the mounting plate and may include divots or notches. The first fastening member may engage with the second fastening member to lock a position of the cheek plate on the mounting plate.

16 Claims, 10 Drawing Sheets

ADJUSTABLE CHEEK RISER WITH AN ADJUSTABLE CHEEK PLATE

CROSS-REFERENCE TO RELATED APPLICATION

This application claims the benefit of priority to U.S. provisional patent application No. 63/256,994, filed on Oct. 18, 2021, and entitled "Adjustable Cheek Riser and Methods," the entirety of which is hereby incorporated by reference as if fully set forth herein.

TECHNICAL FIELD

The present disclosure relates to a firearm stock with an adjustable cheek riser, and more specifically to an adjustable cheek riser.

BACKGROUND

Firearm cheek risers are an integral and important part of modern firearms. Firearm users rest their cheeks on the cheek risers while shooting for an aim. Cheek risers enhance user comfort and shot accuracy when the firearms are used.

A cheek riser is typically mounted on a firearm stock and is attached to the stock by using fastening means such as straps, screws, snaps, and the like. Modern firearms can attach to adjustable cheek risers that may be used by users of different physiologies or while taking aims at different lines of sight. For example, an adjustable cheek riser may enable a firearm user to increase or decrease a cheek riser height to account for the height of a scope over the bore based on the height of the scope mount. Similarly, the adjustable cheek riser may enable the user to adjust the cheek riser height based on user physique and/or height.

While conventional adjustable cheek risers enhance user comfort by enabling them to adjust the cheek risers vertically, there may be instances when the users may desire additional adjustments.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

The present disclosure describes an adjustable cheek riser for a firearm, e.g., a precision rifle. The cheek riser may be mounted on a firearm stock. The cheek riser may be configured to move up or down vertically relative to the stock and/or move laterally along a stock length. The cheek riser may include a mounting plate and a cheek plate that may be removably coupled with each other. A mounting plate inner surface may attach to the stock and a mounting plate exterior surface may be coupled with a cheek plate interior surface. A user may rest her cheek on a cheek plate exterior surface when the user takes an aim with the firearm. The cheek plate may be configured to slide horizontally/laterally along a mounting plate length, thus enabling the user to adjust lateral cheek plate position based on user's shooting requirements and/or physiology.

The mounting plate may be attached to a stock adjustment mechanism, which may enable the user to move the mounting plate (and hence the cheek plate) up or down vertically relative to the stock.

In some aspects, the mounting plate may include a plurality of divots or notches disposed at the mounting plate side edges along the mounting plate length. Further, the cheek plate may include a fastening member (e.g., a male boss) disposed at the cheek plate interior surface, which may be configured to removably couple with the notches. The user may slide the cheek plate along the mounting plate length and may lock a cheek plate position on the mounting plate by inserting the male boss into a notch. Specifically, the user may slide the cheek plate such that the male boss may move from one notch to the next. The cheek plate may be slid from position to position, or removed and reattached at a desired position.

The present disclosure discloses an adjustable cheek riser that enables the user to adjust cheek riser position vertically, as well as horizontally. The user may easily move the cheek riser up or down vertically by using the stock adjustment mechanism and may slide the cheek plate horizontally based on user's needs. Further, the arrangement of the male boss on the cheek plate and the notch on the mounting plate makes it convenient for the user to slide and lock the cheek plate in any desirable position along the mounting plate length.

These and other advantages of the present disclosure are provided in detail herein.

Illustrative Embodiments

The disclosure will be described more fully hereinafter with reference to the accompanying drawings, in which example embodiments of the disclosure are shown, and not intended to be limiting.

Figure 1:
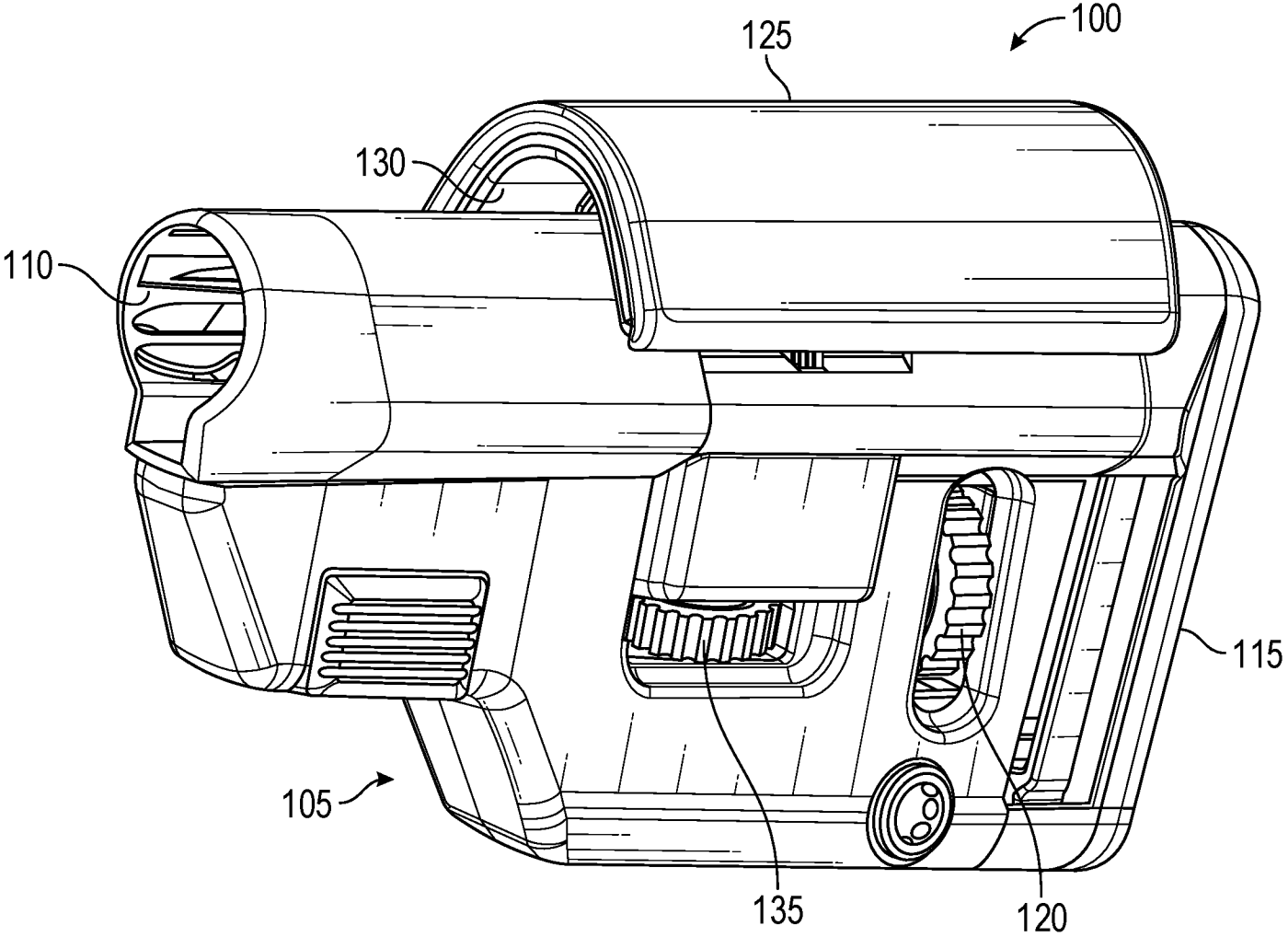
FIG. 1 depicts a perspective view of an adjustable cheek riser mounted on a firearm stock in accordance with the present disclosure.

FIG. 1 depicts a perspective view of an adjustable cheek riser 100 mounted on a firearm stock body 105 (or a stock 105) in accordance with the present disclosure. While describing FIG. 1, references may be made to FIGS. 2-6.

The stock 105 may be configured to removably attach to a firearm (not shown), such as a precisions rifle. The stock 105 may attach to the firearm via a stock front portion 110. The stock 105 may further include a stock rear portion 115 that may touch a firearm user's shoulder when the user uses the firearm. Specifically, the user may rest the shoulder on the stock rear portion 115, which may provide support to the user when the user uses the firearm and may control the effect of firearm recoil.

The stock 105 may additionally include a first adjustment mechanism 120, using which the user may adjust a distance of the stock rear portion 115 (and hence the user shoulder) from a firearm trigger (not shown). Stated another way, the first adjustment mechanism 120 may enable a user to adjust a stock Length of Pull (LoP). The first adjustment mechanism 120 may be disposed vertically along stock 105 height and substantially parallel to stock rear portion 115 height, as shown in FIG. 1. The first adjustment mechanism 120 may include a first gear or a wheel (as shown in FIG. 1) that may extend or retract a stock rear portion 115 position. In an exemplary aspect, the first adjustment mechanism 120 may include a threaded screw (not shown) that may have one end inserted into the first gear or the wheel, and another end attached to the stock rear portion 115. The user may rotate the first adjustment mechanism 120 clockwise or counterclockwise to extend/retract the screw, and hence extend/retract the stock rear portion 115 position from the stock body 105.

A person ordinarily skilled in the art may appreciate that the first adjustment mechanism 120 may enable users of different physiologies (e.g., with different arm lengths) to use the firearm conveniently, by adjusting the distance of the user's shoulder from the firearm trigger. In an exemplary aspect, a user with longer arms may extend the stock rear portion 115 position to use the firearm, and a user with relatively shorter arms may retract the stock rear portion 115 position to use the firearm.

The adjustable cheek riser 100 may include a cheek plate 125 and a mounting plate 130. The mounting plate 130 may be mounted/attached to the stock 105. Specifically, a mounting plate 130 interior surfaces may attach/touch to a stock top portion when the mounting plate 130 is mounted on the stock 105, as shown in FIG. 1. The mounting plate 130 may have an elongated body and may be U-shaped or arcuate-shaped, which may conform to a stock top portion shape.

The cheek plate 125 may be removably coupled to the mounting plate 130. Specifically, a cheek plate 125 interior surface may couple with a mounting plate 130 exterior surface. The cheek plate 125 too may have an elongated body and may be U-shaped or arcuate-shaped, such that the cheek plate 125 may seamlessly overlap with the mounting plate 130 when the cheek plate 125 is coupled with the mounting plate 130.

In some aspects, a cheek plate 125 length may be the same as a mounting plate 130 length, as shown in FIG. 1. In other aspects, the cheek plate 125 length may be more or less than the mounting plate 130 length. Further, the cheek plate 125 and the mounting plate 130 may be made of the same or different materials including, but not limited to, molded plastic, aluminum, wood, etc.

Figure 2:
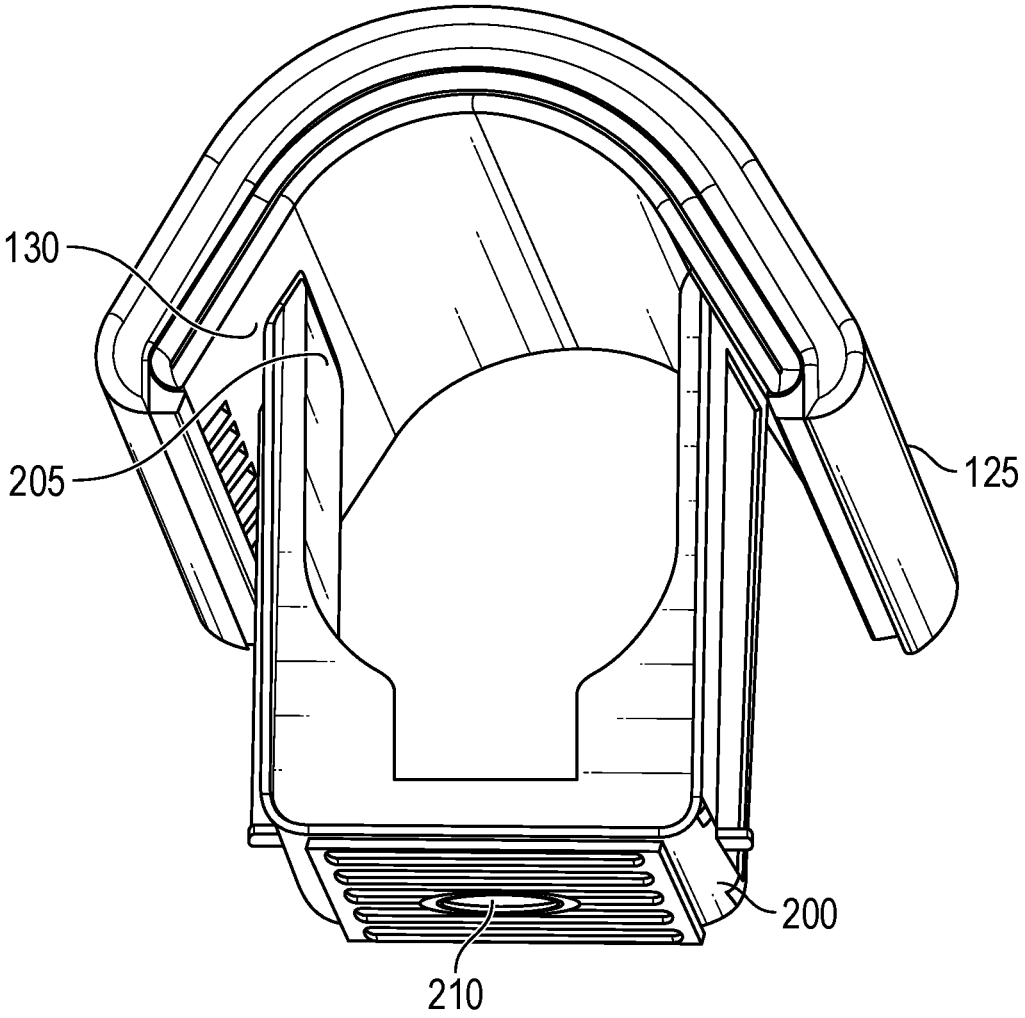
FIG. 2 depicts a perspective view of an elevation mechanism in accordance with the present disclosure.

In an exemplary aspect, the mounting plate 130 may be attached to the stock 105 via an elevation mechanism 200, which is shown in FIG. 2. Specifically, FIG. 2 depicts a perspective view of the elevation mechanism 200 in accordance with the present disclosure.

The elevation mechanism 200 may include a riser 205 that may be rigidly connected with the mounting plate 130 interior surface, as shown in FIG. 2. The elevation mechanism 200 may further include an inlet 210 that may connect with a second adjustment mechanism 135 (that may be embedded into the stock 105) to enable the user to move the mounting plate 130 up or down vertically relative to the stock 105. In an exemplary aspect, the second adjustment mechanism 135 may include a second gear or a wheel (as shown in FIG. 1), and a threaded screw (not shown) that may have one end inserted into the inlet 210 and another end attached to the second gear or the wheel. The user may rotate the second adjustment mechanism 135 clockwise or counterclockwise to move the riser 205 (and hence the mounting plate 130) upwards or downwards relative to the stock 105.

The second adjustment mechanism 135 may be disposed perpendicular to the first adjustment mechanism 120, as shown in FIG. 1. In other aspects, the second adjustment mechanism 135 and the first adjustment mechanism 120 may be disposed at different orientations relative to each other.

Figure 3:
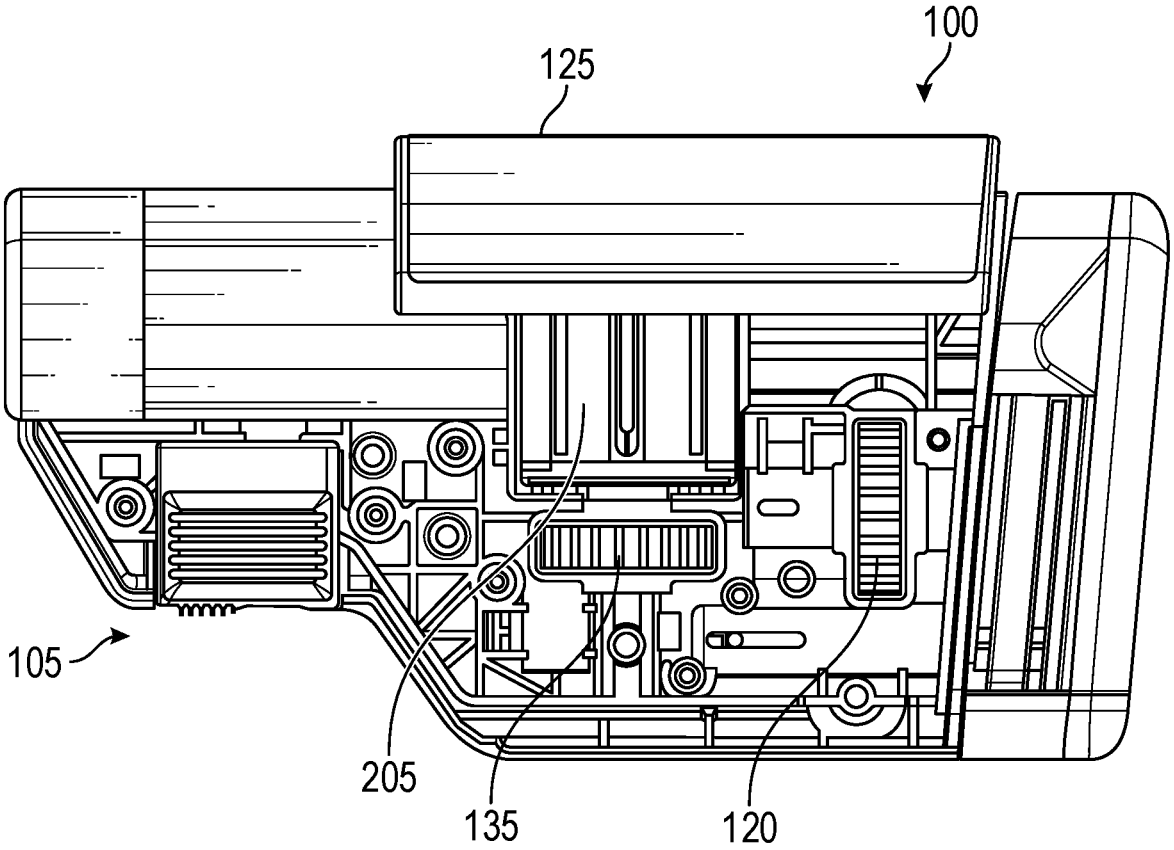
FIG. 3 depicts an open side view of the firearm stock with the adjustable cheek riser, in accordance with the present disclosure.

Another view of the second adjustment mechanism 135 and the first adjustment mechanism 120 is shown in FIG. 3. Specifically, FIG. 3 depicts an open side view of the stock 105 with the adjustable cheek riser 100. As shown in FIG. 3, the second adjustment mechanism 135 may be disposed parallel to the mounting plate 130/cheek plate 125, and perpendicular to the first adjustment mechanism 120.

Figure 4:
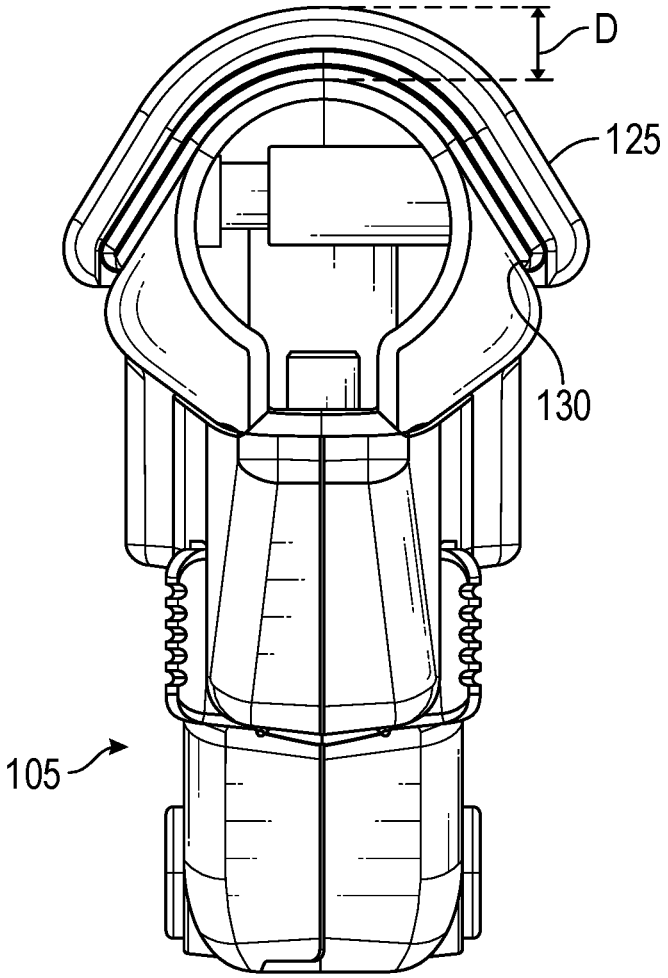
FIG. 4 depicts a front view of the firearm stock with the mounting plate in a first vertical position, in accordance with the present disclosure.
Figure 5:
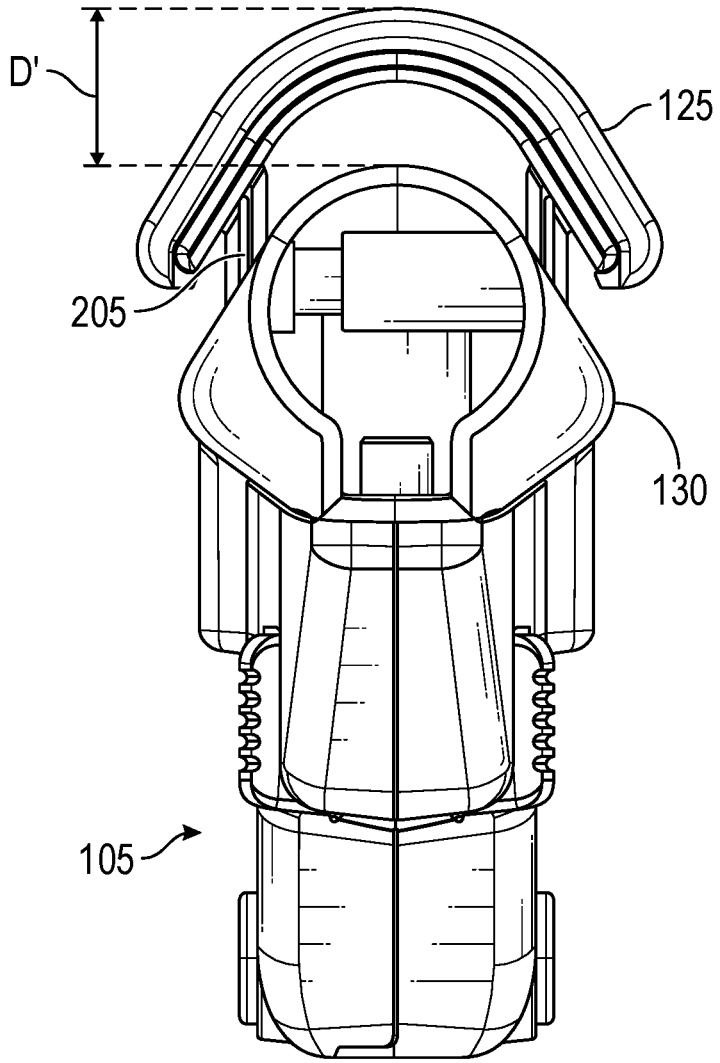
FIG. 5 depicts a front view of the firearm stock with the mounting plate in a second vertical position, in accordance with the present disclosure.
Figure 6A:
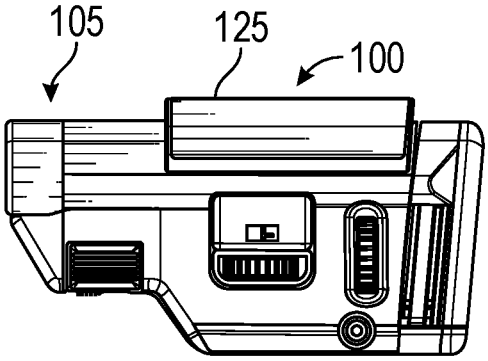
FIGS. 6A-6F depict several views of the adjustable cheek riser on the firearm stock in varying horizontal positions, in accordance with the present disclosure.
Figure 6B:
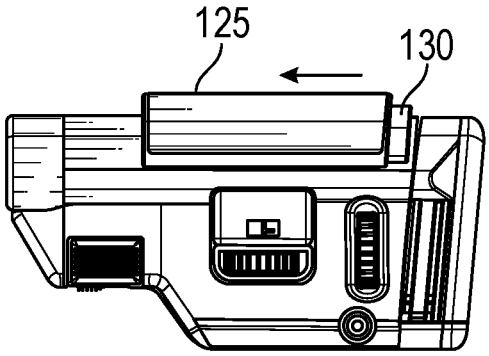
Figure 6C:
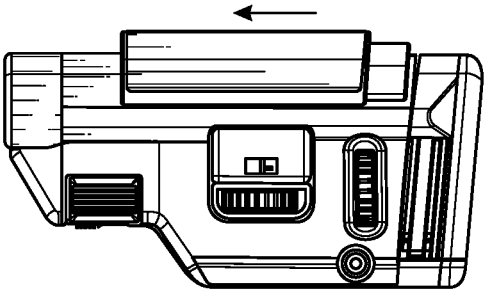
Figure 6D:
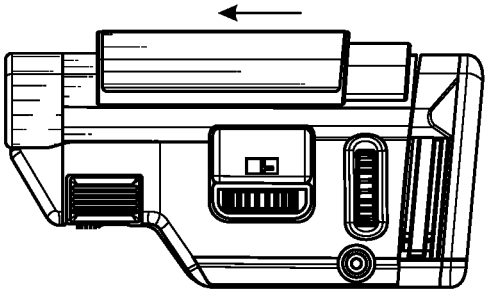
Figure 6E:
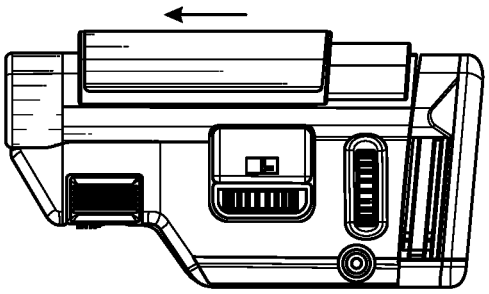
Figure 6F:
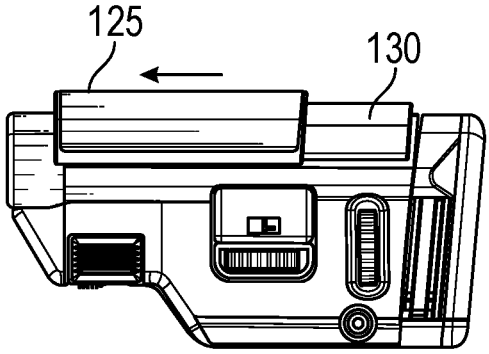

In some aspects, the mounting plate 130 may be attached to the riser 205 (and hence the stock 105 via the second adjustment mechanism 135) such that the mounting plate 130 may not move laterally along a stock or a mounting plate length. Stated another way, the riser 205 may enable mounting plate 130 vertical movement and may not enable mounting plate 130 lateral or horizontal movement. Examples of mounting plate 130 vertical movement are shown in FIGS. 4 and 5. Specifically, FIG. 4 depicts a front view of the stock 105 with the mounting plate 130 in a first vertical position, and FIG. 5 depicts a front view of the stock 105 with the mounting plate 130 in a second vertical position. In the example aspect shown in FIG. 4, the mounting plate 130 may be in a "lowered" or "down" position, where a distance between the mounting plate 130 and the stock top portion may be "D". In the aspect shown in FIG. 5, the mounting plate 130 may be in an "elevated" or "up" position, where a distance between the mounting plate 130 and the stock top portion may be "D."D" may be greater than D, as shown in FIGS. 4 and 5.

As described above, the cheek plate 125 may removably couple with the mounting plate 130. Specifically, the user may removably mount the cheek plate 125 on the mounting plate 130 exterior surface, such that the cheek plate 125 interior surface (or bottom/inner surface) may touch the mounting plate exterior top surface. The user may rest the user's cheek on cheek plate 125 exterior surface, when the user takes an aim with the firearm. Both left-handed and right-handed users may use the cheek plate 125. For example, a left-handed user may rest the user cheek on a cheek plate right-side exterior surface and a right-handed user may rest the user cheek on a cheek plate left-side exterior surface. In some aspects, the cheek plate 125 may have a smooth exterior surface, so that the cheek plate 125 touch may be comfortable for the user.

A person ordinarily skilled in the art may appreciate that since the cheek plate 125 is mounted on the mounting plate 130 and the mounting plate 130 may itself move up and down vertically relative to the stock 105 by using the second adjustment mechanism 135, the cheek plate 125 too may move up and down by using the second adjustment mechanism 135. Stated another way, the user may use the second adjustment mechanism 135 to move the adjustable cheek riser 100 (which includes the cheek plate 125 and the mounting plate 130) up or down vertically by using the second adjustment mechanism 135. For example, the user may move the adjustable cheek riser 100 up when the user aims for a target at a high sight and may move the adjustable cheek riser 100 down when the user aims for a target at a low sight.

The cheek plate 125 may be further configured to slide laterally/horizontally along a mounting plate 130 length. Specifically, the user may slide the cheek plate 125 along the mounting plate 130 length from the stock rear portion 115 to the stock front portion 110 (or vice-versa), as shown in FIGS. 6A-6F. In particular, FIGS. 6A-6F depict several views of the adjustable cheek riser 100 on the firearm stock 105 in varying horizontal or lateral positions, in accordance with the present disclosure.

As shown in FIGS. 6A-6F and as described above, the mounting plate 130 may not move laterally along the stock 105 or the mounting plate 130 length. The user may slide the cheek plate 125 along the stock 105 or the mounting plate 130 length, as shown in FIGS. 6A-6F. While the movement of the cheek plate 125 is described as sliding along the mounting plate 130, it will be appreciated that such includes the acts of detaching the cheek plate 125 from the mounting plate 130 and reattaching the cheek plate 125 to the mounting plate in a new position along the mounting plate 130.

A person ordinarily skilled in the art may appreciate from the description above that the present disclosure enables the user to move the adjustable cheek riser 100 vertically (e.g., by using the second adjustment mechanism 135) as well as horizontally (e.g., by sliding the cheek plate 125 along the stock 105 or the mounting plate 130 length). Thus, the present disclosure provides additional cheek riser adjustment flexibility to the user and enhances user comfort when the user uses the firearm. The details of cheek plate 125 horizontal movement may be understood in conjunction with FIG. 7.

Figure 7:
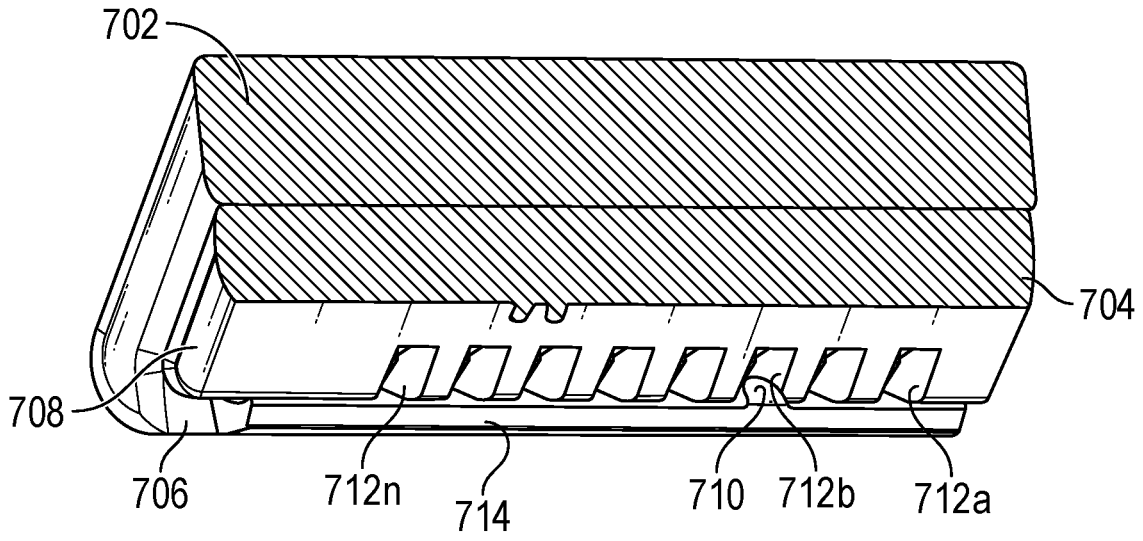
FIG. 7 depicts a cross-section view of a cheek plate and a mounting plate in accordance with the present disclosure.
Figure 8:
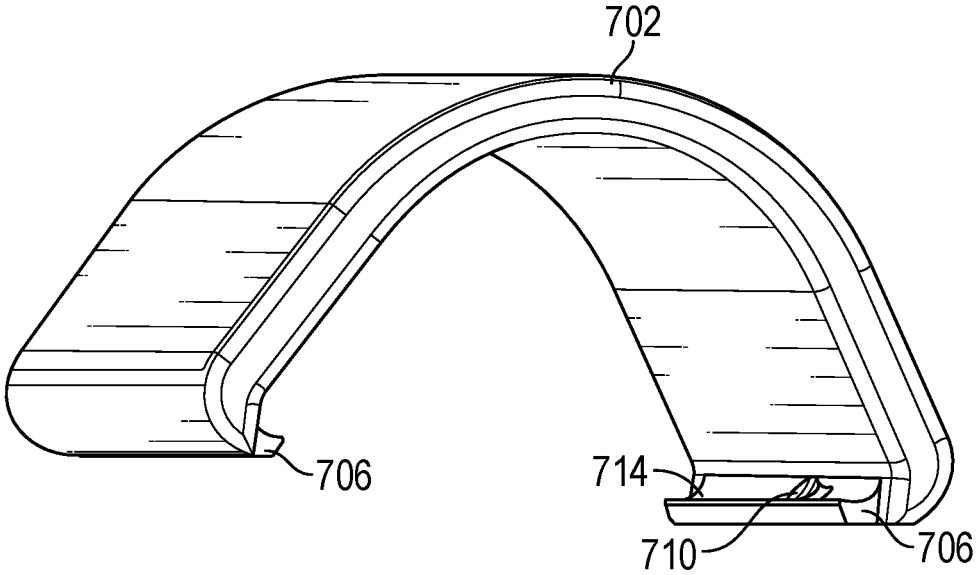
FIG. 8 depicts a perspective view of the cheek plate in accordance with the present disclosure.
Figure 9:
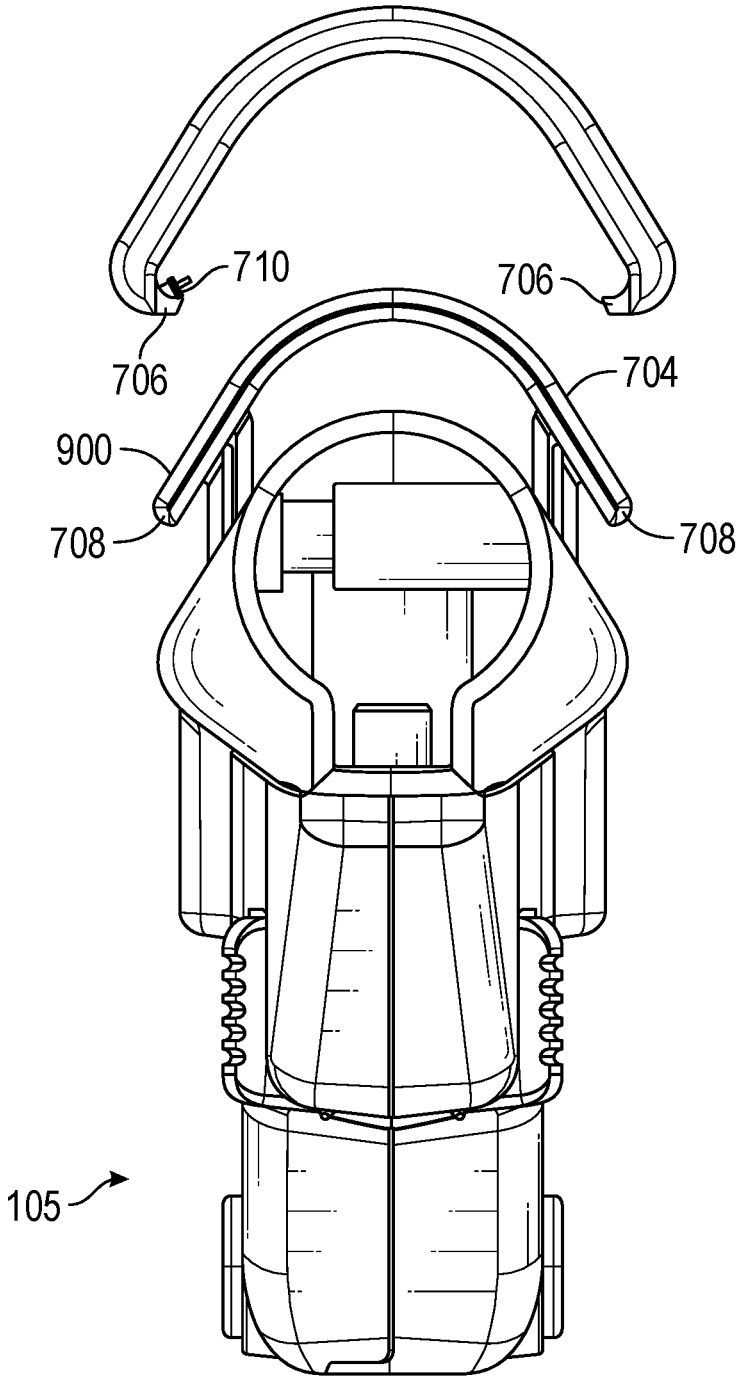
FIG. 9 depicts a front view of the cheek plate and the mounting plate elevated vertically from the firearm stock, in accordance with the present disclosure.

FIG. 7 depicts a cross-section view of a cheek plate 702 and a mounting plate 704 in accordance with the present disclosure. While describing FIG. 7, references may be made to FIGS. 8 and 9. Specifically, FIG. 8 depicts a perspective view of the cheek plate 702, and FIG. 9 depicts a front view of the cheek plate 702 and the mounting plate 704 elevated vertically from the firearm stock 105 in accordance with the present disclosure.

The cheek plate 702 may be same or similar to the cheek plate 125 and the mounting plate 704 may be same or similar to the mounting plate 130. As described above, the cheek plate 702 and the mounting plate 704 collectively may form an adjustable cheek riser (same as the adjustable cheek riser 100). The adjustable cheek riser, including the cheek plate 702 and the mounting plate 704, may be of any suitable length that may allow users of different physiologies to the use the adjustable cheek riser.

The cheek plate 702 may include curved lips 706 (or lips 706) that may be disposed at cheek plate 702 opposing side edges (specifically, underside surface). The lips 706 may be made of same material as the cheek plate 702. The lips 706 may curl inwards towards each other, as shown in FIGS. 7, 8 and 9. In some aspects, the user may mount the cheek plate 702 on the mounting plate 704 by flexing the cheek plate 702 outwards and pressing downwards the cheek plate 702 onto a mounting plate top surface 900 (shown in FIG. 9) so that the lips 706 may "snap" around mounting plate side edges 708. Specifically, the lips 706 may slide down along the mounting plate top surface 900 when the user presses the cheek plate 702 downwards, until the lips 706 pass the side edge 708 on each side of the mounting plate 704 and snap around the mounting plate side edges 708. The cheek plate 702 may securely fit together with the mounting plate 704 when the lips 706 wrap around the mounting plate side edges 708.

As described above, the cheek plate 702 and the mounting plate 704 may be of same shape (e.g., arcuate-shaped), and thus the lips 706 may easily slide downwards along the mounting plate top surface 900 when the user presses the cheek plate 702 downwards. In other words, the arcuate shapes of the cheek plate 702 and the mounting plate 704 allow the user to easily fit/mount the cheek plate 702 onto the mounting plate 704. Further, the cheek plate 702 may be made of a flexible material, which may enable the user to easily flex the cheek plate opposing edges outward and then press the cheek plate 702 downwards onto the mounting plate top surface 900.

In some aspects, the lips 706 disposed on cheek plate 702 underside surface may be disposed along a cheek plate 102 full length, as shown in FIGS. 7 and 8. In other aspects, the lips 706 may be disposed only on a part of cheek plate 702 length.

Although the description above describes an aspect where the user mounts the cheek plate 702 onto the mounting plate 704 by pressing the cheek plate 702 downwards along the mounting plate top surface 900, in some aspects, the user may slide the cheek plate 702 laterally/horizontally along a mounting plate 704 length to mount the cheek plate 702 onto the mounting plate 704. Same arcuate shapes of the cheek plate 702 and the mounting plate 704 may enable the user to easily slide the cheek plate 702 along the mounting plate 704 length. In this case, the lips 706 may engage with the mounting plate side edges 708 as the user slides the cheek plate 702.

In some aspects, the cheek plate 702 and the mounting plate 704 may include a horizontal adjustment mechanism that may enable the user to lock or fasten the cheek plate 702 to the mounting plate 704, when the user mounts the cheek plate 702 onto the mounting plate 704. The horizontal adjustment mechanism may include one or more fastening members.

In some aspects, the horizontal adjustment mechanism may include a first fastening member 710 that may be disposed on lip inner surface 714, and a second fastening member 712*a*, 712*b*, 712*n* (collectively referred to as a second fastening member 712) that may be disposed a mounting plate 704 underside edges or inner surface. In an exemplary aspect, the first fastening member 710 may be a male boss and the second fastening member 712 may include a plurality of divots or notches that may be disposed at equal distance from adjacent divots/notches, and placed along a length of the mounting plate 704, as shown in FIG. 7. In some aspects, the plurality of divots or notches may be disposed along an entire mounting plate 704 length. In other aspects, the plurality of divots or notches may be disposed on a part of the mounting plate 704 length, as shown in FIG. 7.

In operation, the user may fasten or lock the cheek plate 702 to a desired position along the mounting plate 704 length by engaging or "sinking" the male boss with/into one of the divots or notches at the desired location. For example, the user may slide the cheek plate 702 along the mounting plate 704 length (or mount the cheek plate 702 from the top by pressing the cheek plate 702 downwards), and may lock the first fastening member 710 with the second fastening member 712*b* to secure the cheek plate 702 in a position shown in FIG. 7. To further move the cheek plate 702 horizontally along the mounting plate 704 length, the user may disengage (e.g., by pulling the cheek plate 702 outwards) the first fastening member 710 from the second fastening member 712*b* and may slide the cheek plate 702 to a new desired position. In the new desired position, the user may then engage the first fastening member 710 with a second fastening member 712 that may be disposed at the new desired position. For example, the user may slide the cheek plate 702 in a left direction and may lock the cheek plate 702 in an extreme left position by engaging the first fastening member 710 with the second fastening member 712*n*.

In some aspects, a first fastening member 710 shape may be such that it complements a second fastening member 712 shape. Further, the first fastening member 710 shape and the second fastening member 712 shape may be such that the user may easily slide the cheek plate 702 along the mounting plate 704 length and may easily engage/disengage respective fastening members. For example, the first fastening member 710 and the second fastening member 712 may have curved shapes with smooth surfaces, so that the user may easily slide the cheek plate 702 by applying horizontal force.

In additional aspects, the lips 706 may be made of flexible material having a predefined minimum flexibility, which may allow the lips 706 to easily flex outwards and then inwards, as the user slides the cheek plate 702 along the mounting plate 704 length and the first fastening member 710 moves from one second fastening member (e.g., 712*a*) to another (e.g., 712*b*).

A person ordinarily skilled in the may appreciate from the description above the arrangement of the first fastening member 710 and the second fastening member 712 may enable the user to slide or move the cheek plate 702 along the mounting plate 704 length in a controlled manner.

In some aspects, the cheek plate 702 may include more than one first fastening member 710 (e.g., the male boss) disposed on the lips 706. Further, each lip 706 may include one or more first fastening members 710. In other aspects, one lip 706 may include the first fastening member(s) 710, and the second lip may not include any first fastening member.

In further aspects, the first fastening member 710 (e.g., the male boss) may be disposed on the mounting plate 704 and the second fastening member 712 (e.g., the notches/divots) may be disposed on the cheek plate 702.

The shapes of the first fastening member 710 and the second fastening member 712 shown in FIG. 7 are example embodiments and should not be construed as limiting the present disclosure scope. The adjustable cheek riser described in FIGS. 7-9 may work with other types and/or shapes of fastening members. Further, a second fastening member 712 count may be more or less than the count depicted in FIG. 7.

Furthermore, in some aspects, the cheek plate 702 may have a consistent thickness along the cheek plate 702 length, as shown in FIGS. 7 and 8. In other aspects, the cheek plate 702 may have varying thickness along the cheek plate 702 length. For example, the cheek plate 702 may be thicker at a middle portion, between the opposing lips, or may have gradient thickness along the cheek plate 702 length. In another example, the thickness in the middle portion, at the apex of the u-shaped embodiment, may be two to fifteen times the thickness approximate the lips 706. This may allow the user to interchange cheek plates 702 of different thicknesses for various applications or users.

Figure 10:
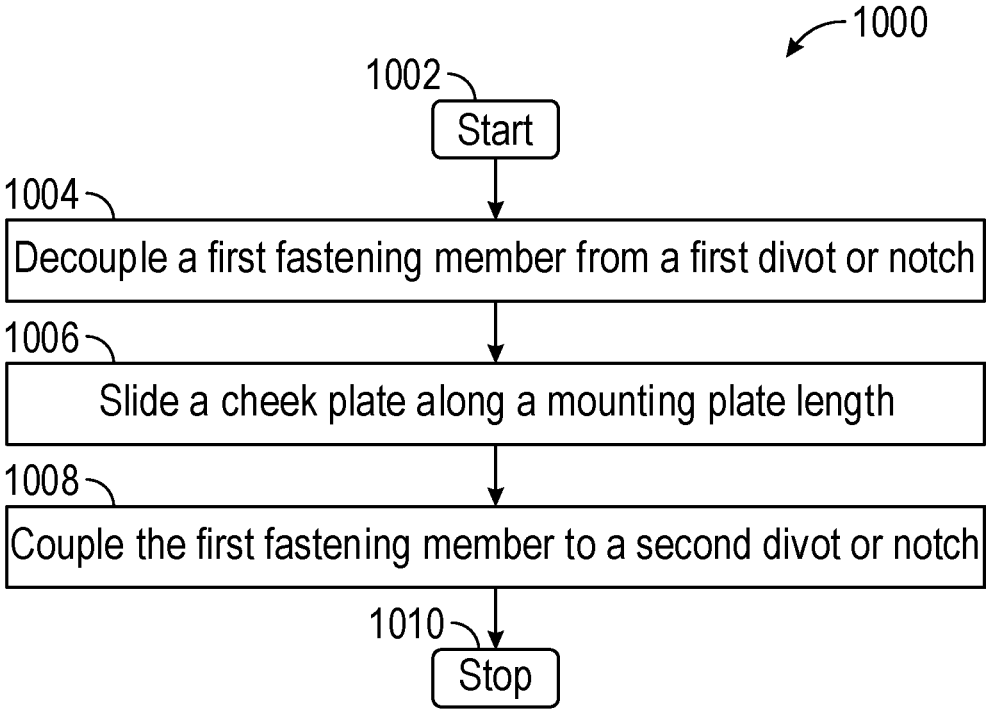
FIG. 10 depicts a flow diagram of an example method for adjusting the cheek plate in accordance with the present disclosure.

FIG. 10 depicts a flow diagram of an example method 1000 for adjusting the cheek plate 702 in accordance with the present disclosure. FIG. 10 may be described with continued reference to prior figures, including FIGS. 1-9. The following process is exemplary and not confined to the steps described hereafter. Moreover, alternative embodiments may include more or less steps that are shown or described herein and may include these steps in a different order than the order described in the following example embodiments.

Referring to FIG. 10, at step 1002, the method 1000 may commence. At step 1004, the method 1000 may include decoupling the first fastening member 710 from a first divot or notch (e.g., the second fastening member 712*b*). As described above, the first fastening member 710 may be a male boss disposed on the lips 706. Further, the first divot or notch may be disposed at a mounting plate 704 first location.

At step 1006, the method 1000 may include sliding the cheek plate 702 along the mounting plate 704 length. At step 1008, the method 1000 may include coupling the first fastening member 710 with a second divot or notch (e.g., the second fastening member 712*n*), to lock the cheek plate 702 to a mounting plate 704 second location. The second divot or notch may be disposed at the mounting plate 704 second location.

At step 1010, the method 1000 may stop.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems and methods described herein, it should be understood that, although some process steps may be described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, the application is capable of modification and variation.

All terms used in the claims are intended to be given their ordinary meanings as understood by those knowledgeable in the technologies described herein unless an explicit indication to the contrary is made herein. Use of the singular articles such as "a," "the," "said," etc., should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. An adjustable cheek riser comprising:
- a cheek plate;
- a mounting plate, wherein the cheek plate is removably coupled to the mounting plate and configured to slide laterally along a mounting plate length; and
- a horizontal adjustment mechanism comprising:
  - a first fastening member disposed on the cheek plate; and
  - a second fastening member disposed on the mounting plate,
  - wherein the first fastening member engages with the second fastening member to lock a position of the cheek plate on the mounting plate, wherein the cheek plate comprises curved lips that removably couple to the mounting plate side edges, and wherein the first fastening member is disposed on the curved lips.

2. The adjustable cheek riser of claim 1, wherein the first fastening member is a male boss.

3. The adjustable cheek riser of claim 2, wherein the male boss is located at a cheek plate inner side edge.

4. The adjustable cheek riser of claim 3, wherein the second fastening member comprises a plurality of divots.

5. The adjustable cheek riser of claim 4, wherein the plurality of divots is located on mounting plate side edges.

6. The adjustable cheek riser of claim 5, wherein the cheek plate is configured to slide laterally along the mounting plate length by moving the male boss from a first divot to a second divot.

7. The adjustable cheek riser of claim 1, wherein the mounting plate is configured to be mounted on a firearm stock.

8. The adjustable cheek riser of claim 7 further comprising a vertical adjustment mechanism configured to vertically adjust a mounting plate position relative to the firearm stock.

9. The adjustable cheek riser of claim 8, wherein the vertical adjustment mechanism is attached to the mounting plate.

10. A firearm stock with an adjustable cheek riser comprising:
- a stock body; and
- the adjustable cheek riser mounted on the stock body, wherein the adjustable cheek riser comprises:
  - a cheek plate;
  - a mounting plate, wherein the cheek plate is removably coupled to the mounting plate and configured to slide laterally along a mounting plate length; and
  - a horizontal adjustment mechanism comprising:
    - a first fastening member disposed on the cheek plate; and
    - a second fastening member disposed on the mounting plate,
    - wherein the first fastening member engages with the second fastening member to lock a position of the cheek plate on the mounting plate, wherein the cheek plate comprises curved lips that removably couple to mounting plate edges, and wherein the first fastening member is disposed on the curved lips.

11. The firearm stock of claim 10, wherein the first fastening member is a male boss.

12. The firearm stock of claim 10, wherein the second fastening member comprises a plurality of divots.

13. The firearm stock of claim 10, wherein the adjustable cheek riser is mounted on the stock body via the mounting plate.

14. The firearm stock of claim 13 further comprising a vertical adjustment mechanism configured to vertically adjust a mounting plate position relative to the stock body.

15. The firearm stock of claim 14, wherein the vertical adjustment mechanism is attached to the mounting plate.

16. The firearm stock of claim 14, wherein a thickness of the cheek plate in a middle portion of the cheek plate is 2 to 15 times a thickness of a lip region of the cheek plate.

* * * * *